US005497602A

United States Patent [19]

Arnold

[11] Patent Number: 5,497,602

[45] Date of Patent: Mar. 12, 1996

[54] SADDLE CLOTH

[75] Inventor: Sidney A. Arnold, Welling, United Kingdom

[73] Assignee: Gordon George Baldwin, Kent, United Kingdom

[21] Appl. No.: 284,563

[22] PCT Filed: Feb. 12, 1993

[86] PCT No.: PCT/GB93/00305

§ 371 Date: Aug. 9, 1994

§ 102(e) Date: Aug. 9, 1994

[87] PCT Pub. No.: WO93/15998

PCT Pub. Date: Aug. 19, 1993

[30] Foreign Application Priority Data

Feb. 13, 1992 [GB] United Kingdom ..... 9202980

[51] Int. Cl.[6] ..... B68C 1/12

[52] U.S. Cl. ..... 54/44.7; 54/66; 2/22

[58] Field of Search ..... 54/44.7, 65, 66, 54/44.5; 2/22, 911

[56] References Cited

U.S. PATENT DOCUMENTS

| | | | |
|---|---|---|---|
| 2,785,407 | 3/1957 | Reeder | 2/22 |
| 4,697,286 | 10/1987 | Cho | 2/22 |
| 5,034,998 | 7/1991 | Kolsky | 2/22 X |
| 5,363,631 | 11/1994 | Garrison | 54/66 |

*Primary Examiner*—Robert P. Swiatek
*Attorney, Agent, or Firm*—Iandiorio & Teska

[57] ABSTRACT

The combination of a mat and a saddle, the mat comprising a non-stiffened layer of foamed polyvinylchloride having a first and a second face, at least one of the first and said second faces having a smooth surface, and the smooth surface being remote from the saddle on installation of the mat and the saddle on the back of an animal whereby the mat forms a saddle-cloth and the smooth surface is in frictional engagement with the animal's back and prevents substantial slipping of the saddle on the animal's back. The combination of a mat and a shin pad for use on a leg of a person is also disclosed.

11 Claims, 2 Drawing Sheets

SADDLE CLOTH

This invention relates to a mat, particularly to a mat for placing on a horse's back beneath a saddle known as a saddle-cloth or "Numnah" (variation Numdah).

Every year, many horse riders fall from their horses when the saddle on which they are seated slips on their horse's back and rotates round the midriff of their horse thus throwing the rider onto the ground under or to one side of the horse. Injuries which in some cases are fatal often occur to a horse rider when this happens. The wearing of a hat by the horse rider helps to prevent injuries to the rider's head. However, serious injuries can still occur to a rider particularly if the rider is either jumping or horse racing. It is thus desirable to prevent such saddle slippage in the first place.

Various types of saddle cloth are known. Most are shaped to conform generally to shape of the lower surface of a saddle. Known saddle-cloths are made of quilted cotton, sheepskin or synthetic sheepskin.

Although such saddle-cloths are an improvement over placing a saddle directly on the horse's back, some are designed for appearance rather than efficiency and they do not properly prevent saddle slip, they soak up sweat from the horse, can be uncomfortable for a horse, and are often difficult to clean and in use become unpleasantly smelly very quickly. They are also quite expensive.

It is an object of the present invention to alleviate some or all of the above mentioned problems.

The present invention provides a mat for use as a saddle-cloth characterised in that it comprises a layer of foamed polyvinylchloride, at least one face of said layer having a smooth surface, the arrangement being such that in use the mat is interposed between an animal's back and a saddle, with the smooth surface in frictional engagement with the animal's back to prevent any substantial slipping of the saddle on the animal's back.

The smooth surface may be "plate finished". This is done by passing the surface of the foamed polyvinylchloride layer over metal plates.

Typically, when used as a saddle-cloth for a horse, the mat will have a thickness of between 4 and 12 mm although thicker or thinner mats are possible.

The preferred thickness of mat for use with racing saddles is around 6 mm.

When the mat is for use as a saddle-cloth for show jumpers and the like a thickness of around 10 mm is preferred for extra comfort.

Preferably, the density of the polyvinylchloride (PVC) foam is between 130 and 160 kg/m$^3$.

The saddle-cloth is shaped and configured to conform generally to the lower surface of a saddle. Thus for a traditional saddle, the mat has a central area which in use fits beneath the central part of a saddle and two further areas on opposite sides to the central area which in use will rest over the upper area of horse's upper thigh beneath the depending flaps of the saddle.

The mat or saddle-cloth can be differently sized and shaped for use with the various different types of saddle such as horse-racing saddles, saddles for a child's pony, rodeo and western style saddles and the like. Further, while the specification refers almost exclusively to use of a mat as a saddle-cloth for a horse, the mat could be used between a saddle or saddlery and any animal or indeed between any two objects which it is desired to keep in relative frictional engagement.

The mat could be permanently or releasably secured to the underside of a saddle to make the saddle and mat a single integral unit.

Specific embodiments of the invention will now be described by way of example only and with reference to the accompanying drawings in which.

Figure 1:
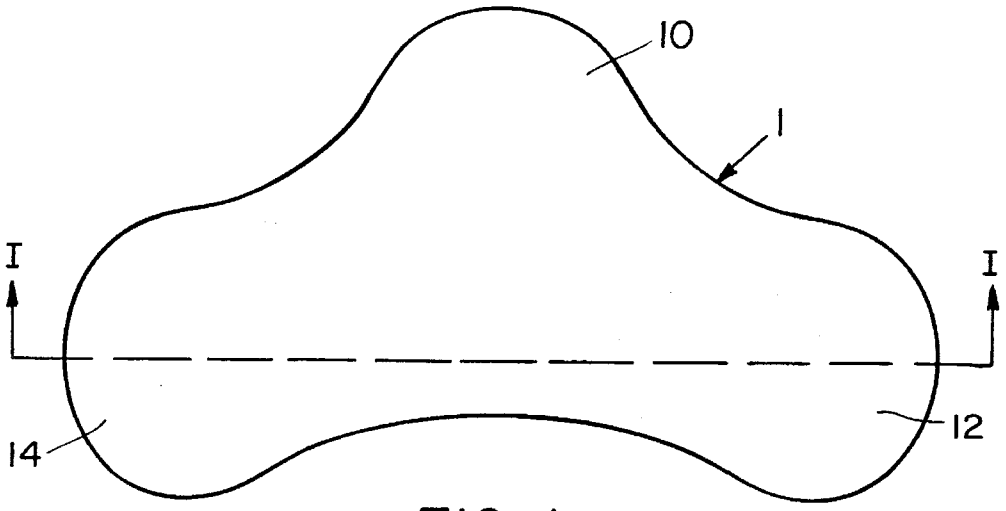
FIG. 1 is a view of a mat seen from above.

Referring to the drawings, FIG. 1 shows a mat or saddle-cloth 1. The mat is configured for use beneath a conventional saddle. It comprises a central area 10 and side portions 12 and 14 which extend away from opposite sides of the central area.

Figure 2:
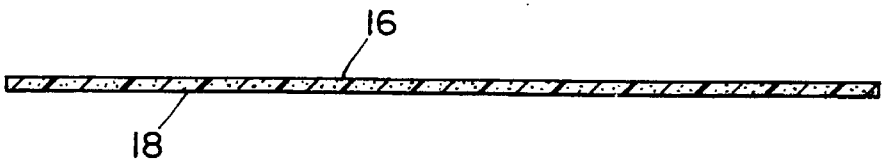
FIG. 2 is a section through line I—I of FIG. 1.

The mat is made from a 10 mm layer of PVC (polyvinylchloride) foam having a density of between 130 and 160 kg/m$^3$. With reference to FIG. 2, the foam mat defines a first, or upper surface 16 and a second, or lower surface 18. The upper surface 16 has a standard finish for foam PVC and is thus relatively rough and textured. The lower surface 18 is "plate finished" by passing the surface over metal plates. This gives surface 18 a smooth and even shine.

In use, the mat is interposed between the back of a horse and a saddle. The smooth surface 18 grips the horse's back extremely firmly and prevents the mat sliding about on the horse. The saddle will stick to surface 16 satisfactorily, inter alia, because the saddle is far less slippery than the horse's back. If the horse gets hot and starts sweating as is usual when a horse is exercised, this does not adversely affect grip of the mat in contrast with existing saddle-cloths which lose grip when a horse sweats since the increased heat makes surface 18 stickier. The weight of the rider and saddle assists in keeping the mat and horse in frictional engagement.

The use of low density PVC foam makes the saddle mat soft, light and comfortable for the horse. The PVC foam is a cellular structure and is permeable to some of the horse's sweated moisture thus improving the comfort to the horse.

Being made of PVC foam, the saddle mat is easily washable and simple to keep clean and odour-free.

Although, the above description relates to mat for use as a saddle-cloth for a standard horse saddle, it is to be understood that a saddle mat embodying the present invention can be made for any size of horse such as a pony or cob and for any shape of saddle. The invention is particularly suitable for use in horse racing in which case the saddle mat will be somewhat thinner, around 6 mm and somewhat smaller so that it confirms with the shape of the racing saddle.

Figure 3:
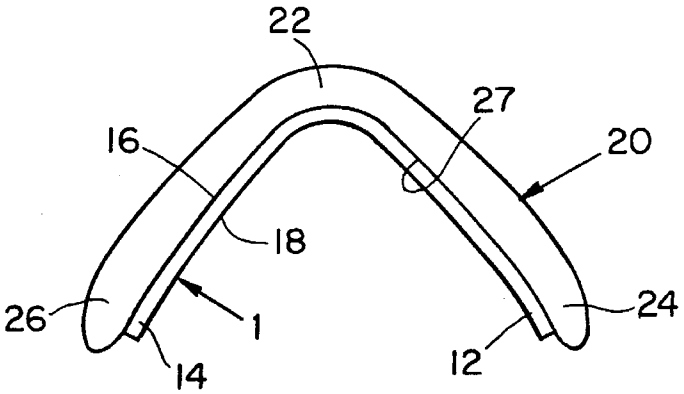
FIG. 3 is a schematic drawing of a saddle with a mat secured to its underside.
Figure 4:
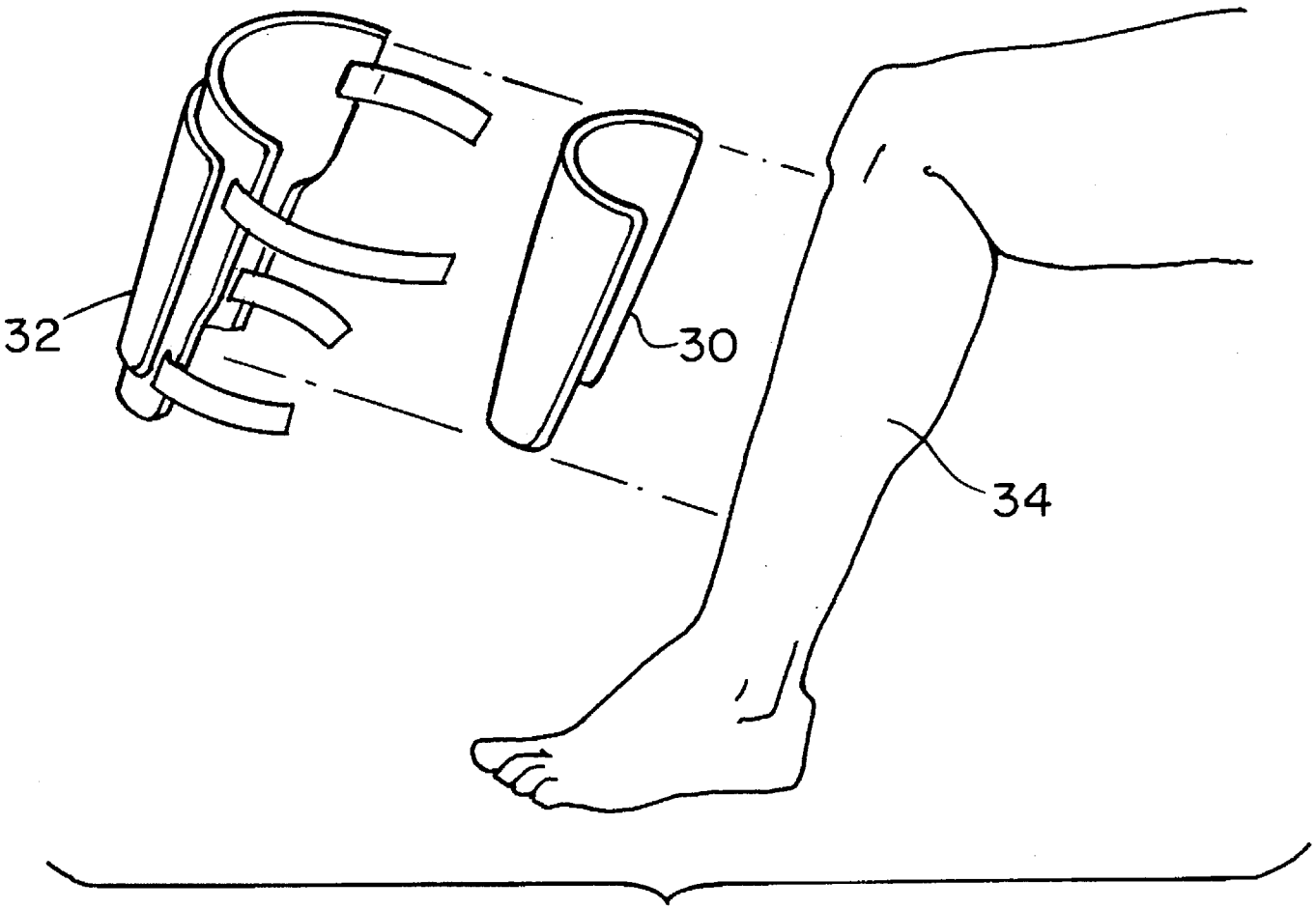
FIG. 4 shows a shin pad and a mat for use on a person's leg.

FIG. 3 is a schematic diagram of a conventional saddle 20 which includes a central part 22 and side flaps 24 and 26. A mat 1 has been attached to the underside of the saddle which is conventionally juxtaposed a horse's back when the saddle is used. The rougher surface 16 of the mat is releasably or permanently secured to the lower surface 27 of the saddle. The plate finished surface 18 is then automatically superposed on a horse's back when the saddle 20 is placed on a horse.

The mat could be used between other animals and saddles. It could also be used to prevent relative movement between various items of saddlery, animal accessories and the like carried or worn by horses or other animals or between other objects other than horses and saddles.

In particular and as shown in FIG. 1 a suitably configured mat 30 could be used between a shin pad 32 and the leg 34 of a person such as a footballer wearing that pad with the plate finished surface of the mat in contact with the person's leg. The mat may also increase the player's comfort because it is flexible and can absorb blows and kicks to the shin pad.

I claim:

1. In combination a mat and a saddle, characterised in that the mat comprises a non-stiffened exposed layer of foamed polyvinylchloride having a first and a second face, at least one of said first and second face having a smooth surface, and said smooth surface being remote from said saddle on installation of said mat and said saddle on a back of an animal whereby said mat forms a saddle cloth, with said smooth surface capable of frictional engagement with said animal's back for preventing substantial slipping of said saddle on said animal's back.

2. The combination according to claim 1 characterised in that the smooth surface is plate finished.

3. The combination according to claim 1 characterised in that the layer has a thickness of between 4 and 12 mm.

4. The combination according to claim 3 characterised in that the polyvinylchloride foam has a density of between 130 and 160 kg/m$^3$.

5. The combination according to claim 1 characterised in that said mat is separate from said saddle.

6. The combination according to claim 1 characterised in that said saddle has a central part and side flaps, and said mat defines a central portion which on said installation fits beneath said central part, and two further portions disposed on opposite sides of said central portion which on said installation lie beneath said side flaps and rest one each over an upper area of an upper thigh of said animal.

7. The combination of a mat and a shin pad, characterised in that the mat comprises a non-stiffened exposed layer of foamed polyvinylchloride having a first and a second face, at least one of said first and second face having a smooth surface, and said smooth surface being remote from said shin pad on installation of said mat and said shin pad on a leg of a person whereby said mat is interposed between said leg and said shin pad with said smooth surface capable of frictional engagement with said leg for preventing substantial slipping of said shin pad on said leg.

8. The combination according to claim 7 characterised in that the smooth surface is plate finished.

9. The combination according to claim 7 characterised in that the layer has a surface of between 4 and 12 mm.

10. The combination according to claim 7 characterised in that said mat is separate from said shin pad.

11. The combination according to claim 7 characterised in that the polyvinylchloride foam has a density of between 130 and 160 kg/m$^3$.

* * * * *